United States Patent [19]

Jette

[11] 4,398,668

[45] Aug. 16, 1983

[54] SHOWERHEAD CONTROL

[76] Inventor: Emile Jette, 1328 N.W. 110 Terrace, Miami, Fla. 33161

[21] Appl. No.: 266,743

[22] Filed: May 26, 1981

Related U.S. Application Data

[63] Continuation-in-part of Ser. No. 41,055, May 21, 1979, Pat. No. 4,311,279, which is a continuation-in-part of Ser. No. 971,051, Dec. 19, 1978, abandoned, which is a continuation-in-part of Ser. No. 868,200, Jan. 9, 1978, Pat. No. 4,273,289, which is a continuation-in-part of Ser. No. 863,694, Dec. 29, 1977, abandoned, which is a continuation-in-part of Ser. No. 818,441, Jul. 25, 1977, abandoned, which is a continuation-in-part of Ser. No. 790,277, Apr. 25, 1977, abandoned, which is a continuation-in-part of Ser. No. 743,766, Nov. 22, 1976, abandoned.

[51] Int. Cl.[3] ..... B05B 7/12

[52] U.S. Cl. ..... 239/414; 4/596; 4/604; 137/625.41; 137/637; 239/416.2; 239/562; 239/574; 239/578; 239/587

[58] Field of Search ..... 239/414, 416.2, 562, 239/574, 578, 579, 587; 137/625.41, 637; 4/596, 597, 604, 605

[56] References Cited

U.S. PATENT DOCUMENTS

| | | | |
|---|---|---|---|
| 3,047,239 | 7/1962 | Canavan | 239/579 |
| 3,156,260 | 11/1964 | Harvey et al. | 137/625.41 |
| 3,322,152 | 5/1967 | Aechter | 137/625.41 |
| 3,380,478 | 4/1968 | Garrison | 137/625.41 |
| 4,200,123 | 4/1980 | Brandelli | 239/587 |

FOREIGN PATENT DOCUMENTS

| | | | |
|---|---|---|---|
| 1291297 | 10/1972 | United Kingdom | 137/625.41 |

*Primary Examiner*—John J. Love
*Assistant Examiner*—Michael J. Forman

[57] ABSTRACT

A showerhead control structure having an extending control operator, defining, a showerarm provided having a separate hot and cold water port for connection to existing hot and cold water supply lines in a showerstall wall comprising, a first pivotal ball and socket waterflow control valve structure to shut off the water flow in at least one pivotal position by swinging movement of the extending operator and in combination a second waterflow control valve structure to vary the water spray temperature and shut off the waterflow therethrough by rotational movement of the extending operator.

8 Claims, 7 Drawing Figures

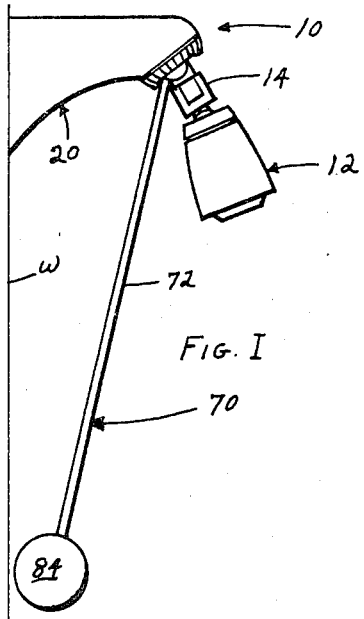
FIG. I
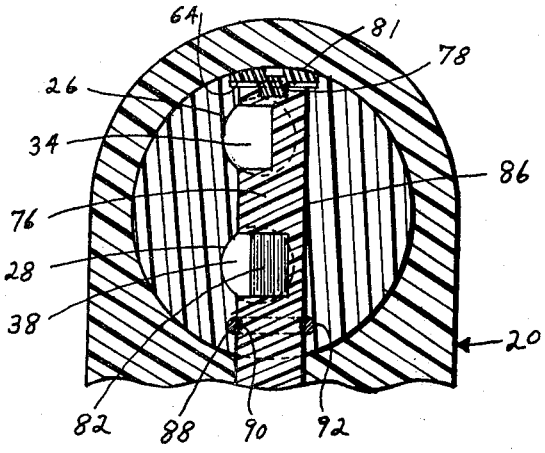
FIG. III
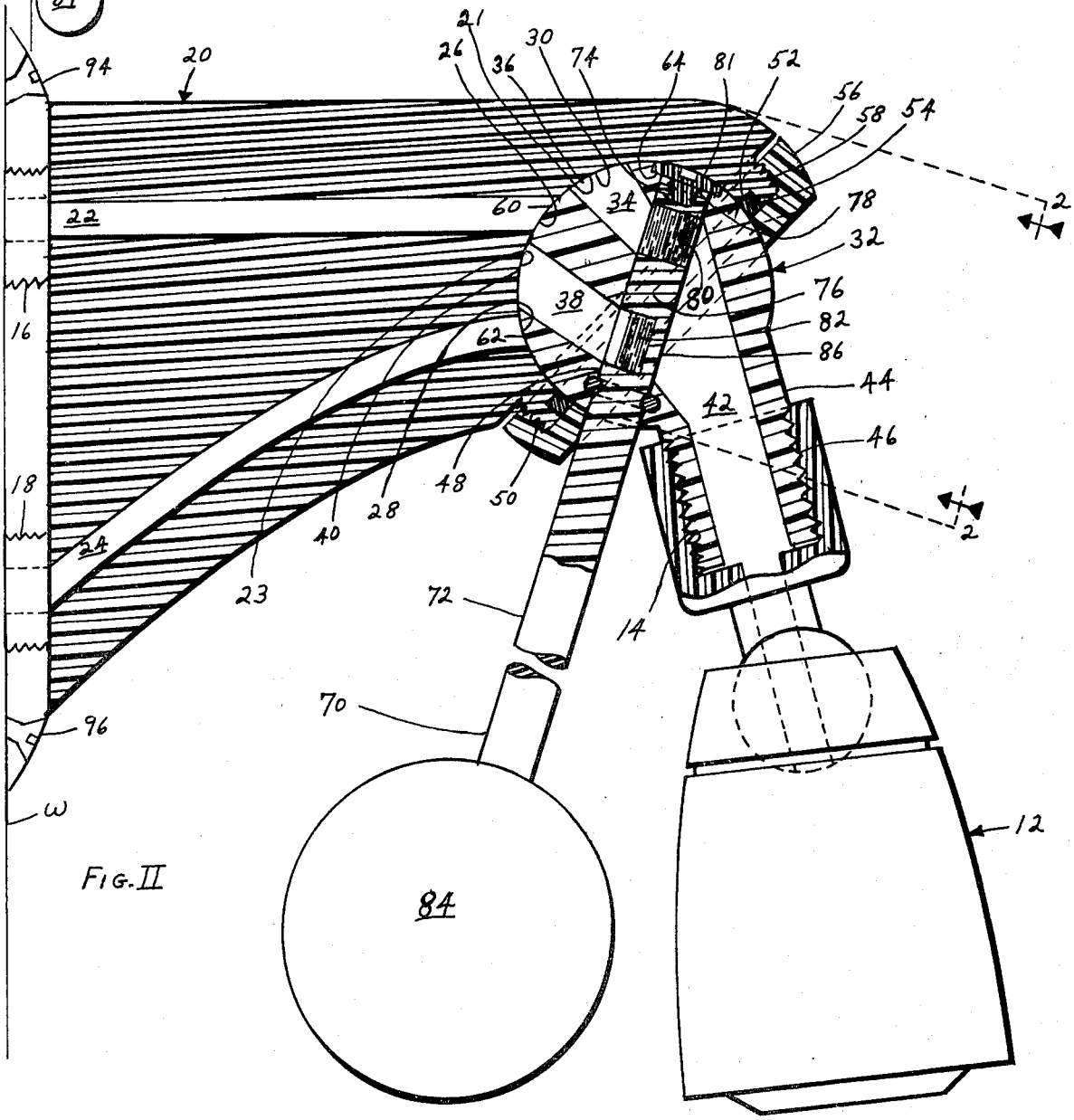
FIG. II

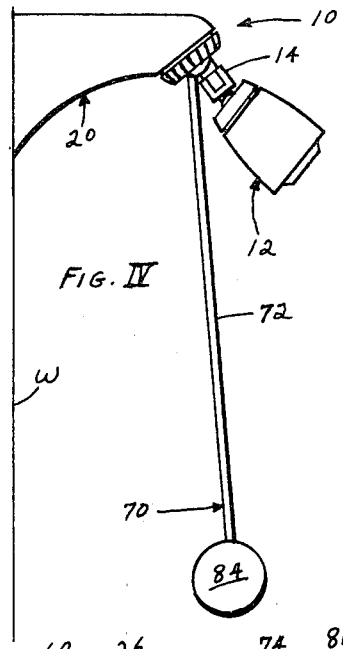
FIG. IV
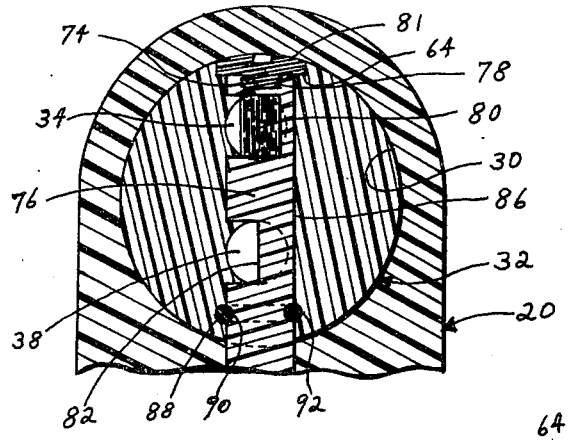
FIG. VI
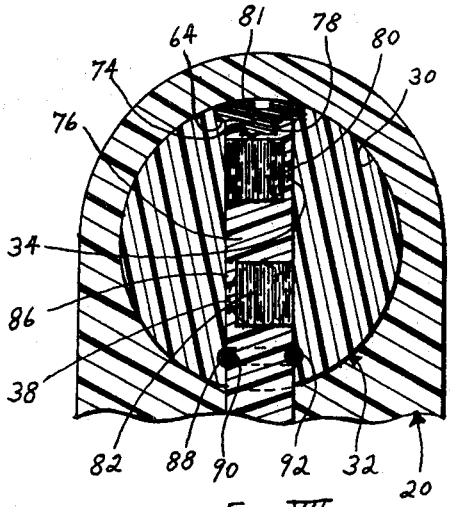
FIG. VII
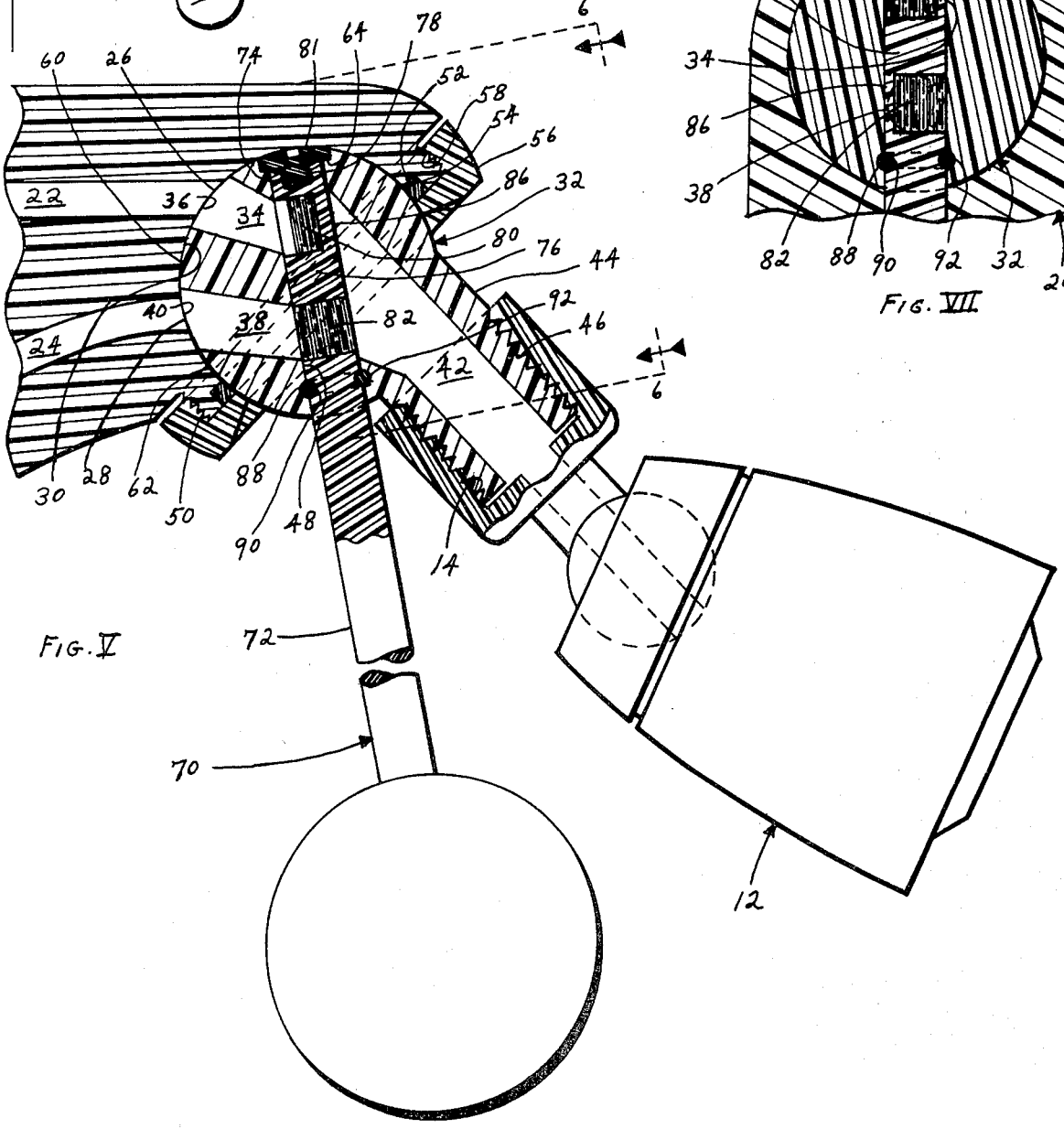
FIG. V

SHOWERHEAD CONTROL

This is a continuation-in-part of Ser. No. 041,055, filed May 21, 1979, now U.S. Pat. no. 4,311,279, issued Jan. 19, 1982, which is a continuation-in-part of Ser. No. 971,051 filed Dec. 19, 1978, now abandoned, which is a continuation-in-part of Ser. No. 868,200, filed Jan. 9, 1978, now U.S. Pat. No. 4,273,289, issued June 16, 1981, which is a continuation-in-part of Ser. No. 863,694, filed Dec. 29, 1977, now abandoned, which is a continuation-in-part of Ser. No. 818,441, filed July 25, 1977, now abandoned, which is a continuation-in-part of Ser. No. 790,277, filed Apr. 25, 1977, now abandoned, which is a continuation-in-part of Ser. No. 743,766, filed Nov. 22, 1976, now abandoned.

FIELD OF THE INVENTION

This invention pertains to showerhead showerarms and more particularly to a showerarm providing an elongate operator to control the positioning of a connected conventional showerhead relative to a user and including ball and socket means in the showerarm whereby the water supply may be selectively shutoff by swinging movement of the operator handle to a "neutral" position or shut off the water supply and additionally vary the waterspray temperature by rotational movement of the handle. The operator for the showerhead extends downwardly and away from the showerhead and out of the water spray and it is effective to vary the water spray temperature and shut the water off and on which flows through to the showerhead.

BACKGROUND OF THE PRESENT INVENTION

Showerheads are generally threadedly connected to the end of a rigid water conduit showerarm defining an extended water supply pipe above a bathtub or a shower stall wherein water is supplied by manipulation of a faucet or faucets. Usually the showerhead provides ball and socket movement swingable to direct the water spray from the showerhead in a predetermined range of movement within the bathtub or shower stall. This invention is of a showerarm having separate hot and cold water ports and a ball and socket valve and it is characterized by a elongate member which extends downwardly from the valve and out of the direction of the water spray from the showerhead when it is in an open position to a terminal end, which is preferably provided with a ball or other bulbous or enlarged device so as not to injure a person taking a shower. By twisting the rod or rotating the end, the showerarm operator will control so that a valve within it is moved from an valve open position to a valve closed position and additionally vary the water temperature within a range between a hot and cold waterspray.

Generally, individual hot and cold water faucets or simple lever-type of faucet is connected to hot and cold water conduits for sources of supply through the supply consuit. The faucet or faucets are manipulated to the proper hot and cold mixture to achieve a desired water temperature for the water flowing through the showerhead. The mixed hot and cold water then enters a single conduit to the showerhead where it passes through a discharge port in the device and is sprayed outwardly upon a user.

To adjust the direction of spray, a user must physically grasp any of the single or multiple outlet spray heads, provided in the prior art, and turn it to a desired position. If a user desires to shut off the water supply after he has wetted himself, so that he can "soap-up" or shampoo his or her hair, the faucet or faucets must be turned off and then turned on and readjusted to a desired hot and cold mixture for the rinsing-off operation. Particularly in relatively small bathtub and shower enclosures, generally provided in most bathrooms, it is very difficult to evade the shower spray while soaping-up or shampooing the hair.

It will be appreciated that handicapped persons who must sit in the tub but who may also desire the benefits of a shower, find that it is most difficult to do so.

This invention provides a downwardly extending operator, which is out of the direction of the spray of the water from the showerhead at all times in use and which may be simply rotated or pivoted to a valve closed position to shut off the water supply by controlling the valve structures to be described hereinafter which are included in the showerarm. It is at once seen that this is highly advantageous, especially to a handicapped person sitting in the bathtub, since the length of the elongate control rod is such that the terminal end is accessible to him while in a sitting position and, by this means, he may control the shower spray direction through a limited range of movement, control the ball and socket valve structure to shut off the water when he so desires and further, control the water temperature. It should be understood that there will be an extremely large savings of the amount of water and hot water energy which is actually used, since a person may simply wet himself down, shut the valve off using the single elongate operator which is conveniently accessible, soap-up, or shampoo his hair, and then turn the valve on readily, without the need for adjusting the temperature of the water.

In one embodiment of the instant invention, the device of the present invention provides an extended elongate operator, generally in the form of a rod, extending down from the showerarm having a water temperature control valve structure portion on the upper end with a protective ball or enlarged portion on the extended terminal end fixed in relation to the showerarm ball and socket to permit a user to vary the water spray temperature, shut off the water supply or universally position the showerhead within predetermined limits all by manipulation of the single rod or operator terminal end which is conveniently located out of the path of the water spray. The showerarm socket and ball valve showerhead connection is formed in a manner so as to provide water temperature control means and shut off valving means when it is rotated to a valve closed position or in a first position attitude or range of pivotal movement calculated to direct the water spray into the shower basin, tub, or stall where a person normally will be standing or sitting. The ball and socket connection is formed in a manner so as to provide for swinging movement of the showerhead by manipulation of the rigidly connecting shower rod to a valve closed position closing both the hot and cold water supply ports without upsetting the hot and cold water mixture, and a user need only to push the handle to a movement limit position to shut the water off and to move the showerhead through the easily accessible control rod to a normal in use position to turn the water on. This showerarm invention is designed to supersede the conventional faucet or faucets wherein this device provides the elements and technology necessary to implement the functions provided by conventional faucet or faucets, that is, turn the water on and off and regulate the spray water temperature and additionally the convenience to adjust the water spray direction. The technology provided by this invention also proves to conserve measurable amounts of water and the hot water energy involved and by volume will contribute somewhat toward the progressively worsening energy and water shortages.

Therefore, one of the principal objects of the present invention is to provide a showerarm having separate hot and cold water supply ports, a ball and socket valve included having conventional showerhead connection means, operable by rotational movement of a generally outwardly and downwardly extending operator control handle in the form of an elongated extension from the shower arm to position the showerhead to adjust a desired spray direction and to control water flow temperature through the showerarm as illustrated in FIGS. 2, 3, 4 and 5 and to be hereinafter described in detail.

Another principal object of this invention is to provide valve means in the showerarm, operable by the handle means, to shut off the valve to control the flow if water through the showerarm so that, when the elongate extending control is pivotally moved into a zone in range of movement a first water flow control valving arrangement is effective to substantially cut off the water by pivotal valve movement; however, it does not completely interrupt a small flow of water at a maximum pivotal valve closed position, so that there is, at all times, a small trickle which is adapted to flow through the device when the second water flow control valve is on, which is well known in the art and, indeed, is required by some plumbing codes. It will be appreciated that compliance with these plumbing codes will in no way interfere with or subtract from the overall concept disclosed herein and claimed of a operator which extends away from the showerarm and a spray of water from the showerhead and which includes a portion which is accessible below the water head for pivotal movement of the ball and socket together with the showerhead to operate a valve means included in the showerarm device to be described for turning on and off the water supply through the showerarm.

Another object of the invention is to provide showerarm valve means completely independent of the faucet or faucets controlling the flow of hot and cold water from a source of supply and an operator valve portion therefrom included in the showerarm structure and which in combination is swingable with the extending control rod for operating the first waterflow valve means portion and by rotable movement of the operator control the second waterflow valve means to vary the spray water temperature and effectively completely stop hot and cold water passage through the showerarm.

It is also an object of the instant invention to provide an operator which includes, on the terminal end, in the embodiment of an extending rod which is a safety device to protectively cover the extending end of the rod and which is in the form of a ball in the preferred embodiment illustrated.

A still further object of the invention, in combination with that described above, is to omit the necessity of conventional faucets, utilize this showerarm invention to control water flow supply and regulate the water temperature by manipulation of a single extending elongate control operator conveniently accessible and to conserve measurable amounts of water and hot water energy.

Generally speaking, it is an overall object of this invention to provide a device that is simple and inexpensive to install in new construction which is adapted to provide in a shower or tub environment, a showerarm which includes a extending operator which is at all times out of the direction or path of the spray from the operator and which includes a handle on the terminal end being accessible below the shower for pivotal and rotational movement of the operator to control a valve means within the showerarm effective on the rotational and pivotal movement of the extending operator to open and close the flow of water in a main path through the device, regulate water temperature and adjust the direction of the water spray.

In accordance with these and other objects which will become apparent hereinafter, the instant invention will now be described with reference to the accompanying drawings, in which:

BRIEF DESCRIPTION OF THE DRAWINGS

FIG. 1 is a side elevation view of the showerarm control device of the present invention in combination with a conventional type showerhead connected to the control ball nipple portion;

FIG. 2 similar to FIG. 1 is an enlarged fragmentary view in cross-section of the showerarm with the ball and socket first flow control valve means in a "water off" position and the second water temperature control valve means in a hot water temperature adjustment, with parts broken away to illustrate the structural detail thereof;

FIG. 3 is a front plan view taken along the broken lines 2—2 of FIG. 2 and looking in the direction of the arrows, further depicting the second water temperature ball and control operator valve means structure adjusted for passage of a hotter degree of water flow;

FIG. 4 of sheet 2 is a side elevation view of the showerarm control device similar to FIG. 1 with the first flow control valve structure in a "water on" position and the connected showerhead adjusted to direct a higher spray;

FIG. 5 is a view similar to FIG. 2 illustrating the first control valve structure in a "water on" position and the second control valve structure adjusted for passage of a cooler water flow therethrough the nipple;

FIG. 6 is a front plan view taken along broken lines 6—6 indicate in FIG. 5 and looking in the direction of the arrows illustrating the second water temperature control valve in a cooler water flow adjustment and FIG. 7 is a front plan view similar to FIGS. 3 and 6 depicting the second water flow control valve structure operator portion blocking the hot and cold water supply port discharges, in a "water off" position.

DESCRIPTION OF A PREFERRED EMBODIMENT OF THE INVENTION

Referring to the drawings wherein like reference characters designate like or corresponding parts throughout the various views and with particular reference to FIGS. 1 and 4, a showerarm assembly including the control device of the present invention is indicated generally by numerals 10 and 70.

One form of the device is composed, generally of three principal portions: first a showerarm 20 adapted for connection to a hot and cold water supply; second a ball valve 32 having a protruding nipple portion 44 threaded for engagement in the female fitting 14 of a conventional showerhead 12 and ball valve 32 being constricted in socket 30 of showerarm 20 to permit a predetermined range of universal pivotal movement by an extending elongate control operator 70 rigidly connected for rotational movement in ball valve 32, having the axial centerline of operator 70 extend outward and downwardly at a predetermined acute angle with respect to the axial centerline of a water passageway 42 of nipple 44, to from an area at all times out of the passageway water flow, permit a user to in combination control a first waterflow valve structure to shut off the water flow and position the water flow direction and control a second water flow valve structure to substantially and completely shut off the flow of water and additionally adjust the water flow temperature, to subsequently be described.

A conventional showerhead 12 is coupled at 14 to assembly 10 connected at 94 and 96 and extending from a wall W in a bathtub or shower enclosure having separate hot and cold water supply lines existing within, to be connected to a hot water connector fitting 16 and a cold water fitting 18 portions of showerarm 20 included having a hot water port 22 and a cold water port 24 that extend longitudinally therethrough of a predetermined diameter with a hot water discharge 26 and a cold water discharge 28 opening into valve socket 30 companionalely mated and sized to receive ball valve 32 having a hot water through opening 34 with an inlet 36 and a cold water through opening 38 with an inlet 40 discharging into passageway 42 extending through and discharging from an extending ball 32 connector nipple 44 portion of ball valve 32 provided having screwthreads 46 mated for connection at 14 of a conventional showerhead 12.

Ball valve 32 includes a diametrical through bore 48 designed to snugly rotatably journal the upper end 76 of the extending control operator 70, being of a predetermined diameter, ball valve 32 is captivated in the socket 30 portion of showerarm 20 having peripheral screwthreads 50 and an internal shoulder 52 to receive and seat seal 54, when an annular retainer ring 56 is screwthreaded at 58 into showerarm 20 captivating ball 32 in socket 30, compressing seal 54 and constricting a first waterflow control ball valve surface 60 and 62 of ball 32 included having a connector recess 64 at the top of bore 48 being a diameter larger than that of bore 48, provided for captive rotational movement of operator 70, to be hereinafter be explicated.

Control operator 70 comprising an elongate member 72, having axial internal threads 74 in the upper end 76 to receive screwthreads 78 of a retainer cap 81 having a diameter sized a degree smaller than the diameter of recess 64, necessary to retain control operator end 76 in rigid rotational position in bore 48 for manual control of a second water flow and temperature valve structure comprising upper end 76 providing adjacent cordal cut out planes 80 and 82 disposed having plane 80 cut at a predetermined degree angle different than the plane of cut out 82 to permit water flow temperature adjustment means through passageway 42 by rotational movement of a handle 84 carried on the member 72 extending distal end and as illustrated in FIG. 7 the second waterflow valve control structure is positioned wherein the full diameter peripheral valve surface 86 of end 76 is in blocking engagement of through openings 34 and 38 closing the hot and cold water flowing from the openings into passageway 42 to completely shut off the water supply therethrough. As illustrated in FIG. 2, ball 32 is pivotally positioned to control the first water flow valve structure, whereby the port 22 and 24 discharges 26 and 28 are blocked by ball valve 32 surfaces 60 and 62 and the inlets 36 and 40 of openings 34 and 38 are blocked by portions 21 and 23 of showerarm 20 to substantially stop the hot and cold water flow from discharges 26 and 28 however, the first valve structure is designed to permit a predetermined amount of water leakage to help prevent a differential pressure drop between the hot and cold water supplies when in a fully water off position and with reciprocal pivotal movement the axial center line of the hot and cold water discharges 26 and 28 will be coincident with the hot and cold water inlets 36 and 40 and water supply from ports 22 and 24 will flow into through openings 34 and 38 at the same temperature before the shut off operational movement and as seen in FIGS. 2 and 3 the second water flow temperature valve structure is adjusted having the plane of cordal cut out 80 which is separate from plane 82, disposed depicting a fully open hot water path therethrough into passageway 42 and the plane 82 being disposed further contracting the cold water through opening 38 to admit a water flow volume therethrough somewhat less than the water volume flowing the water cut out plane 80, thus the water flow through passage 42 is adjusted to flow a degree warmer and depicted in FIGS. 5 and 6, the second valve structure is adjusted to dispose the hot water cut out plane 80 somewhat contracting opening 34 to limit hot water flow through opening 34 into passageway 42 and the cut out plane 82 adjusted to a fully open position to permit a greater volume of cold water to flow through opening 38 into passageway 42, hence the water flow through passageway 42 is regulated to flow a degree cooler, accordingly the water flowing through passageway 42 into showerhead 12 may be selectively varied within a range of between a hot and cold waterflow or as depicted in FIG. 7, completely shut off by movement the second waterflow control valve means when the upper end 76 is rotated within the bore 48 the through opening 34 and 38 are blocked closed by the circumferential surface 86 to completely stop any water from flowing through the nipple 44 into showerhead 12.

Depicted in FIGS. 2–3 and 5–7 an annular seal means 88 is inter-imposed between annular groove 90 in member 72 and annular groove 92 in the diametrical through bore 48 of ball valve 32 to eliminate water leakage there between the bore 48 and member 72 included having the retainer cap 81 is provided to enable the disassemble of control member 72 from ball 32 for cleaning purposes by unscrewing annular ring 56 permitting removal of ball 32 from socket 30 to expose retainer cap 81 allowing the cap to be disconnected from the upper end 76 and the extraction of member 72 from captivation within the bore and upon reassemble of the essential elements, seal 54 and 88 may be replaced if necessary.

To further insure tighter and total valve structures, seal means may be included between the ball 32 and socket 30 and between the bore 48 and upper end valve surface 86.

This showerarm control assembly is designed to replace conventional faucet or faucets existing in a shower enclosure and to provide a new and convenient means to control shower waterflow volume, temperature and direction by manipulation of one single control operator.

The showerarm, having a water flow ball and socket valve structure and the extending elongate control operator water temperature valve structure is designed to conserve water and hot water energy.

FIG. 4 depicts showerhead 12 pivotally adjusted to raise the direction of the water spray, with the additional pivotal means of the ball 32 and socket 30 a greater range of spray direction is provided, to wash and rinse walls, for example.

The second water flow control valve means comprising, the upper end 76 journaled in the bore 48, captivatingly retained by cap 81 inserted in the recess 64 and screwthreadedly connected to the upper end 76 and with the showerhead control structure assembled the first water flow control valve means comprising ball 32 captivated in socket 30 by retainer 56, the socket 30 constrains cap 81 in recess 64 to limit the second control valve to rotational movement only and the retainer ring and retainer cap provide means to disassemble the first valve means wherein the elongate control operator 70 may be removed from the journaled connection to permit cleaning of the valve means.

The upper end 76 is of a predetermined diameter larger than the diameter of the through openings 34 and 38, the diameter of bore 48 is a predetermined diameter larger than the diameter of end 76.

The annular seal 54 provides means to prevent water leakage to bypass the ball 32 and socket 30 engagement and additionally by adjustment of the retainer ring 56 constrict seal 54 for increasing the friction between the seal and the ball 32 spherical surface to compensate for the showerhead 12 overhanging cantilever connection to the nipple 44.

The annular grooves 90 and 92 provide means to seat annular seal 88 preventing water to bypass the upper end 76 and bore 88 journaled connection.

What is claimed is:

1. A showerhead control structure including means to control both waterflow and temperature therethrough for connection to a hot and a cold water line comprising:

(A) a showerarm adapted to be rigidly connected to a wall, said showerarm having separate hot and cold water ports extending longitudinally therethrough having respective hot and cold water water supply connection means, said hot and cold water ports discharging into a first ball and socket water flow control valve structure including a ball having separate hot and cold water through openings, a diametrical through bore in said ball extending transverse to said through openings having a connector recess at an upper end of said through bore, seal means in a lower portion of said through bore and said ball including a spherical valve surface portion providing substantially universal movement in the socket of said first ball and socket water flow control valve structure with respect to the hot and cold water discharge ports, said first ball and socket water flow control valve structure permitting water flow from said showerarm to said respective hot and cold water through openings in at least one universal position and the flow of water into said ball being blocked by said spherical valve surface in at least one other universal position, said first ball and socket water flow control valve structure including peripheral connector means for retaining said ball and socket in engagement, said first ball and socket water flow control valve structure having a combined hot and cold water flow passageway downstream of said diametrical through bore, said first ball and socket water flow control valve structure being provided with means for connection to a showerhead downstream of said ball, (B) a second rotatable water flow control valve structure defined by an elongate control operator having a distal end and an upper end, said elongate control operator being journalled in said diametrical through bore, said upper end having spaced respective hot and cold water chordal cut-out means positioned to cooperate with respective downstream ends of said hot and cold water through openings to vary the water-flow temperature downstream of said elongate control operator upon rotational adjustment of said elongate control operator with respect to said ball when said first ball and socket water flow control valve structure is in a position permitting water flow from said showerarm to said ball.

2. The showerhead control structure as set forth in claim 1 wherein the combined hot and cold water passageway is positioned within a nipple extending from said ball and said nipple is provided with threaded connection means for attachment of said showerhead.

3. The showerhead control structure as set forth in claim 2 wherein said peripheral connector means includes screw threads about the periphery of the socket of the first ball and socket control valve structure, said socket also includes an annular shoulder to seat seal means, and an annular retaining ring mated for threaded connection with said first mentioned screw threads to universally captivate the ball in the socket.

4. The showerhead control structure as set forth in claim 2 wherein the means for retaining the elongate control operator in said diametrical through bore includes the ball being provided with a recess at an upper end of the diametrical bore, said elongate control operator being provided with a longitudinal bore at an upper end thereof, said bore of said elongate control operator being provided with screw threads, and a retainer cap received within said recess and having screw threads cooperating with the screw threads of said elongate control operator.

5. The showerhead control structure as set forth in claim 1 wherein said spaced respective hot and cold water chordal cut-out means includes a hot water chordal cut-out having a plane disposed at an angle of a predetermined degree different than a plane of a cold water chordal cut-out wherein said hot water through opening will be closed or opened into the combined hot and cold water passageway in contrast with the opening and closing of the cold water through opening to in unison regulate the hot and cold water flow volume through the second rotatable control valve structure into said combined hot and cold water passageway providing water temperature varying means by rotational movement of the upper end by manipulation of said elongate control operator distal end.

6. The showerhead control structure as set forth in claim 5 wherein said hot water chordal cut-out is positioned with respect to said cold water chordal cut-out in said elongate control operator such that by a predetermined degree of rotational movement of said elongate control operator flow through both said hot and cold water through openings will be substantially closed.

7. The showerhead control structure as set forth in claim 1 wherein the showerarm includes connecting means to a showerstall wall.

8. The showerhead control structure of claim 1 wherein said spaced respective hot and cold water chordal cut-out means are disposed to close said hot and cold water through openings in a predetermined degree of rotational movement of said elongate control operator.

* * * * *